72-453.0F
10/15/85 XF 4,546,637

United States Patent [19]

Elias

[11] Patent Number: 4,546,637

[45] Date of Patent: Oct. 15, 1985

[54] BLIND-RIVET SETTING TOOL

[75] Inventor: Anthony J. Elias, Bondi Junction, Australia

[73] Assignee: Spurway Cooke Industries Pty., Ltd., Victoria, Australia

[21] Appl. No.: 550,258

[22] Filed: Nov. 10, 1983

[30] Foreign Application Priority Data

Nov. 18, 1982 [AU] Australia ..... PF6868

[51] Int. Cl.[4] ..... B21D 31/00

[52] U.S. Cl. ..... 72/391; 72/453.11; 72/453.06

[58] Field of Search ..... 72/391, 453.01, 453.17, 72/453.18, 453.19, 453.1, 453.11, 453.02, 453.03, 453.04, 453.06; 92/130 C

[56] References Cited

U.S. PATENT DOCUMENTS

| | | | |
|---|---|---|---|
| 399,789 | 3/1889 | Scott | 72/453.11 |
| 2,374,019 | 4/1945 | Kahler et al. | 72/453,11 |
| 3,374,656 | 3/1968 | Maio | 72/391 |
| 3,898,833 | 8/1975 | Richardson | 72/391 |
| 4,005,598 | 2/1977 | Ehmann et al. | 72/453.19 |
| 4,118,969 | 10/1978 | Corbett | 72/391 |
| 4,120,188 | 10/1978 | Schwab | 73/391 |
| 4,454,746 | 6/1984 | Schwab | 72/391 |

FOREIGN PATENT DOCUMENTS

| | | | |
|---|---|---|---|
| 2040775 | 9/1980 | United Kingdom | 72/391 |
| 773256 | 10/1980 | U.S.S.R. | 72/453.1 |

*Primary Examiner*—Daniel C. Crane
*Assistant Examiner*—David B. Jones
*Attorney, Agent, or Firm*—B. B. Olive

[57] ABSTRACT

A power operated blind-rivet setting tool comprises a hand-piece which carries a rivet pulling plunger and a piston in a cylinder furnished with a trigger operable valve for admission of working fluid to one or other end of the cylinder. A piston rod joined by one end to said piston has its other end operatively connected to the plunger, and a compression spring sleeved on said piston rod is so arranged as to store energy during a non-working stroke of said piston and to release that energy during a working stroke of the piston.

7 Claims, 2 Drawing Figures

BLIND-RIVET SETTING TOOL

Figure 1:
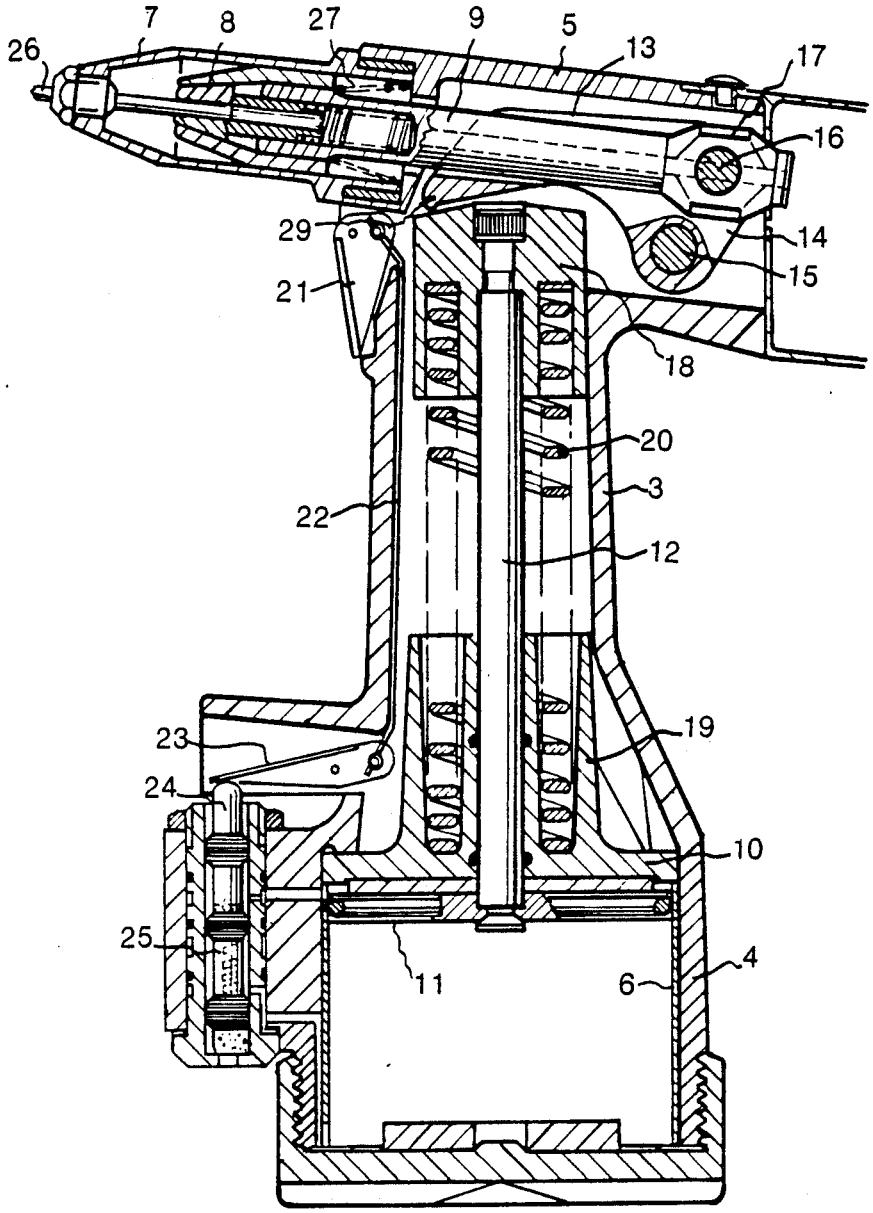

This invention relates to setting tools for blind rivets; that is, those well-known rivets comprising a tubular shank headed at one end, and equipped with a headed nail which so extends through the shank as to permit the un-headed end of the shank to be up-set by the nail head on the far side of the work entirely by operation conducted on the near side of the work.

Setting tools for blind rivets are well known; but, so far as we are aware, none of the prior tools has been entirely satisfactory, particularly where the tool is to be sustainedly employed over long work periods likely to cause fatigue on the part of the tool user.

By this invention, a tool of the kind in question is of compact and light-weight construction, largely by reason of the tool being in the form of a relatively small, manually-held, pistol-grip implement whereof the centre of gravity of the tool as a whole is well below that of the axis in the direction of which rivet-setting is effected, and also because the tool embodies a rivet-setting, double-acting, reciprocating motor of small overall dimensions, since what would otherwise be its unproductive non-working or return stroke is put to work by spring storage of its energy output, for release in contribution to the energy output of the rivet-setting or working stroke of the motor.

The invention provides a blind-rivet setting tool comprising:

(a) a hollow columnar handpiece having a lower end formed as a working cylinder and having a tubular barrel disposed athwart its upper end, (b) a cylinder head disposed athwart the interior of said handpiece defining the upper end of said cylinder, (c) a piston in said cylinder, (d) a rivet-pulling plunger movable longitudinally within said barrel and having one end adjacent an open end of said barrel therewith to constitute a rivet nail-stem chuck, (e) a piston rod disposed inside said handpiece and having said piston on its lower end and having its upper end positioned in or adjacent said barrel, (f) transmission mechanism whereby upward movement of said piston rod causes said plunger to recede away from the open end of said barrel, thereby causing said plunger to execute a rivet-setting, working stroke, (g) resilient loading means urging upward movement of said piston rod, and (h) control means whereby working fluid is admitted to said cylinder for performance of working and return strokes of said piston.

Figure 2:
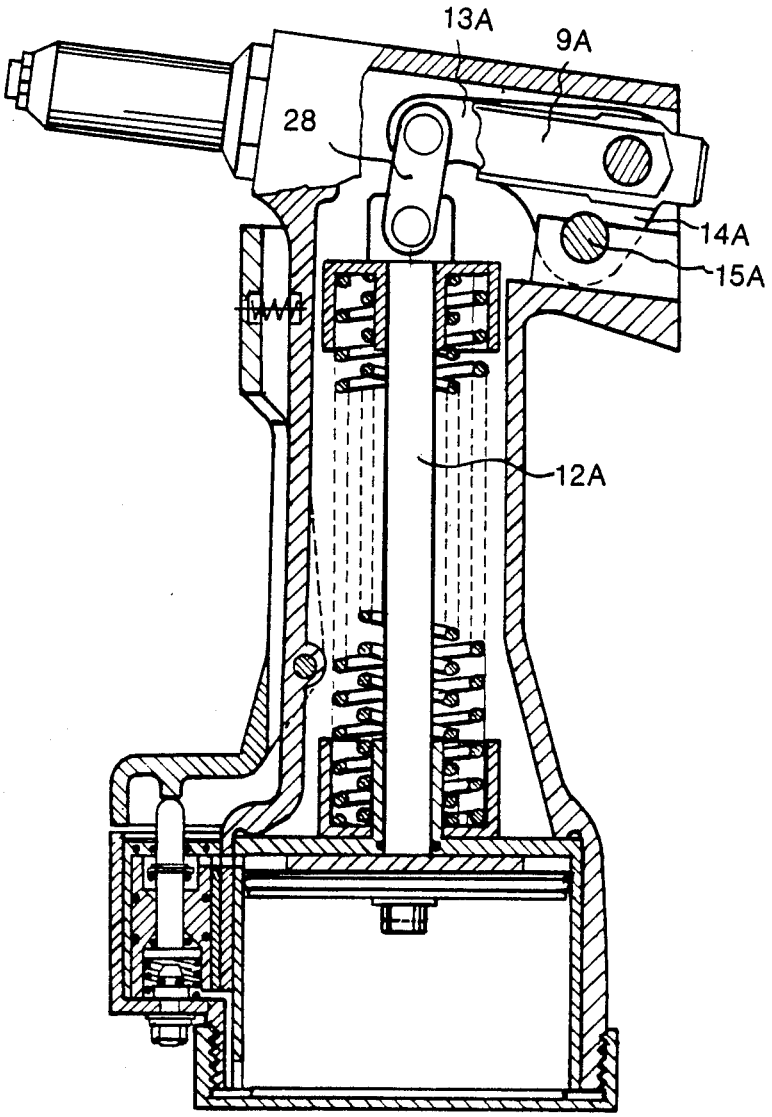

Certain terms used herein, such as "lower" "upper" and others implying a specific disposition or orientation are employed for descriptive convenience. They are literally correct when the tool subject hereof is in its most frequently used work disposition as shown in the drawings herewith;

FIG. 1 being a medial cross-sectional side elevation of an example of the tool subject hereof and FIG. 2 a similar view of a slightly modified arrangement.

Referring to FIG. 1 of the drawings, a hollow columnar hand-piece 3 has its lower end formed as a cylinder 4 and has an integral tubular barrel 5 disposed athwart its upper end. Hand-piece 3 may be formed as a light-weight metal moulding or as a die casting, but for preference it is made as a moulding of fibre-reinforced plastics material. In the latter event, the cylinder 4 is preferably furnished with an appropriate liner sleeve as indicated at 6.

The barrel 5 carries a chuck-nozzle 7 to co-operate, in conventional manner, with chuck-jaws 8 on the end of a rivet-pulling plunger 9 which is axially movable within barrel 5.

A cylinder head 10 defines the upper end of cylinder 4. Piston 11 works in cylinder 4 and is fixed on the lower end of a piston-rod 12. This rod extends upwardly through hand-piece 3 and its upper end is operatively contacted, by one arm 13 of a bell-crank 14 fulcrumed on the hand-piece at 15 and pivoted, at 16, to the non-working end 17 of plunger 9.

Piston-rod 12 has an upper, spring-seating ferrule 18 fixed thereon. Head 10 carries a similar bottom spring-seating ferrule 19. A loading spring 20 is sleeved about piston-rod 12 and has its ends seated in ferrules 18 and 19.

Control means whereby working fluid is admitted to either end of cylinder 4, consists of a finger-operable trigger-lever 21 connected by pull-wire 22 to lever 23 associated with the stem 24 of a conventional piston valve 25 for admission and exhaust of working fluid to the opposite ends of cylinder 4. This also is well known technology.

The movable parts of the tool, as shown in FIG. 1, are in the position of just having completed a working, rivet-setting stroke and about to relinguish the beheaded shank 26 of a blind rivet nail. When the chuck is cleared, the un-headed end of a fresh blind-rivet nail may be placed in the chuck assembly (7, 8). A non-working stroke may then be executed. This consists in lowering piston 11 to the bottom end of cylinder 4, so that plunger 9 advances, under the influence of spring 27, towards nozzle 7 thus enabling the chuck to take hold on the newly emplaced blind rivet nail, and, at the same time spring 20 is compressed. During the following working or rivet-setting stroke, plunger 9 is reverted to the position shown for it in the drawing, and this working stroke is effected by the force due to piston 11 plus that due to energy stored in spring 20 during the previous non-working stroke.

The amount of energy stored in spring 20 during each non-working stroke may be a substantial fraction of that required for execution of a working, rivet-setting stroke thus permitting cylinder 4 and piston 11 to be much smaller than would otherwise be necessary.

Referring to FIG. 2, the arrangement there shown is substantially the same as that already described except for the manner in which the upper end of the piston rod 12A is operatively associated with plunger 9A. In this arrangement the bell-crank 14A is fulcrumed at 15A as before, but has one arm 13A coupled to the upper end of piston rod 12A by a link 28.

Reverting to the arrangement shown in FIG. 1 it will be seen that the bearing tip 29 of arm 13 bears on the end face of ferrule 18 further from the axis of the piston rod 12 at the end of the working stroke than it does at the beginning of that stroke, thereby enhancing the mechanical advantage due to the bell-crank at the time when such advantage is most needed; that is, at the time immediately prior to tensile failure (fracture) of the headed nail, by which the rivet is set, at the end of the working stroke.

I claim:

1. A blind-rivet setting tool comprising:

(a) a hollow columnar handpiece having a lower end formed as a working cylinder and having a tubular barrel disposed athwart its upper end;

(b) a cylinder head disposed athwart the interior of said handpiece defining the upper end of said cylinder;

(c) one but not more than one piston in said cylinder;

(d) a rivet-pulling plunger movable longitudinally within said barrel and having one end adjacent an open end of said barrel therewith to constitute a rivet nail-stem chuck;

(e) a piston rod disposed inside said handpiece and having said piston secured to its lower end and having its upper end positioned in or adjacent said barrel;

(f) transmission mechanism whereby upward movement of said piston rod causes said plunger to recede away from the open end of said barrel, thereby causing said plunger to execute a rivet-setting, working stroke;

(g) control means whereby working fluid is admitted to said cylinder for performance of working and return strokes of said piston; and (h) resilient loading means operatively associated with said piston rod and cylinder head for urging upward movement of said piston rod, which loading means are strained so as to store energy during each return stroke and relax during each working stroke to deliver energy to said piston rod.

2. A tool according to claim 1 wherein said resilient loading means comprise:

a top spring-seating ferrule on the upper end of said piston rod, a bottom spring-seating ferrule on said cylinder-head, and a compression spring sleeved on said piston rod between said ferrules.

3. A tool according to claim 2 wherein (a) said transmission mechanism comprises a bell-crank fulcrumed on said hand-piece, having one arm pivoted to said plunger and its other end bearing on said top ferrule, and (b) said plunger is spring-loaded to influence said other end to remain bearing on said top ferrule.

4. A tool according to claim 2 wherein said transmission mechanism comprises a bell-crank fulcrumed on said hand-piece, having one arm pivoted to said plunger and its other end link-connected to said top ferrule.

5. A working fluid operated blind-rivet setting tool comprising:

(a) a hollow handpiece having a lower end formed as and defining one end of a working cylinder and having a tubular barrel disposed across the opposite end of said handpiece;

(b) a cylinder head disposed within said handpiece defining an opposite end of said cylinder and mounting outside said cylinder a bottom spring seating ferrule;

(c) one but not more than one piston in said cylinder;

(d) a rivet-pulling plunger movable longitudinally within said barrel and mounting adjacent an open end of said barrel a rivet nail-stem chuck;

(e) a piston rod disposed inside said handpiece and mounting said piston on one end, having its opposite end positioned proximate said barrel and mounting on said opposite end a top spring seating ferrule opposing said bottom spring seating ferrule;

(f) a transmission mechanism interconnecting said piston rod top spring seating ferrule and rivet pulling plunger such that movement of said piston rod top spring seating ferrule toward said rivet pulling plunger causes said plunger to recede away from said open end of said barrel and execute a rivet-setting, working stroke;

(g) manually controlled means mounted on said handpiece for controlling admission of a working fluid to said cylinder for performance of working and return strokes of said piston; and (h) resilient loading means urging upward movement of said piston rod comprising a compression spring sleeved on said piston rod between said ferrules, said spring being compressed so as to store energy during each return stroke and being relaxed so as to deliver energy to said piston rod during each working stroke.

6. A tool according to claim 5 wherein (a) said transmission mechanism comprises a bell-crank fulcrumed on said hand-piece, having one arm pivoted to said plunger and its other end bearing on said top ferrule, and (b) said plunger is spring-loaded to influence said other end to remain bearing on said top ferrule.

7. A tool according to claim 5 wherein said transmission mechanism comprises a bell-crank fulcrumed on said hand-piece, having one arm pivoted to said plunger and its other end linkconnected to said top ferrule.

* * * * *